United States Patent [19]

Manders et al.

[11] 4,261,850

[45] Apr. 14, 1981

[54] PROCESS FOR MANUFACTURE OF POWDERED DETERGENT COMPOSITIONS CONTAINING FATTY ACID SOAPS

[75] Inventors: Johannes L. C. Manders, Roosendaal; Robert E. Niemansverdriet, Rotterdam, both of Netherlands

[73] Assignee: Lever Brothers Company, New York, N.Y.

[21] Appl. No.: 36,893

[22] Filed: May 7, 1979

[30] Foreign Application Priority Data

May 11, 1978 [GB] United Kingdom ..... 18975/78

[51] Int. Cl.[3] ..... C11D 9/04; C11D 11/02

[52] U.S. Cl. ..... 252/108; 252/109; 252/110; 252/121

[58] Field of Search ..... 252/108, 109, 110, 121

[56] References Cited

U.S. PATENT DOCUMENTS

| | | | |
|---|---|---|---|
| 2,925,390 | 2/1960 | Flitcraft et al. | 252/116 |
| 2,991,253 | 7/1961 | Sheely et al. | 252/121 |
| 3,242,091 | 3/1966 | Monick | 252/109 |
| 3,907,702 | 9/1975 | Mostow | 252/370 |
| 4,065,398 | 12/1977 | Brouwer | 252/108 |

FOREIGN PATENT DOCUMENTS

| | | | |
|---|---|---|---|
| 590346 | 1/1969 | Canada | 252/109 |
| 52-31202 | 8/1977 | Japan | 252/108 |
| 943405 | 12/1963 | United Kingdom | 252/109 |
| 1294581 | 11/1972 | United Kingdom | 252/110 |
| 1371101 | 10/1974 | United Kingdom | 252/109 |

*Primary Examiner*—P. E. Willis, Jr.

[57] ABSTRACT

A washing powder containing soap, normally in relatively large quantities, is made by combining a slurry containing washing powder components with a stream containing fatty acid or soap or a mixture of these. The fatty acid may be liquid or molten or in solution. The slurry is combined with the stream in such a way that the two are thoroughly admixed, for instance by feeding them to a pressurizing pump. When fatty acid is to be combined with the slurry, the latter will contain sufficient excess alkali to form soap in situ.

7 Claims, 2 Drawing Figures

Figure 1:
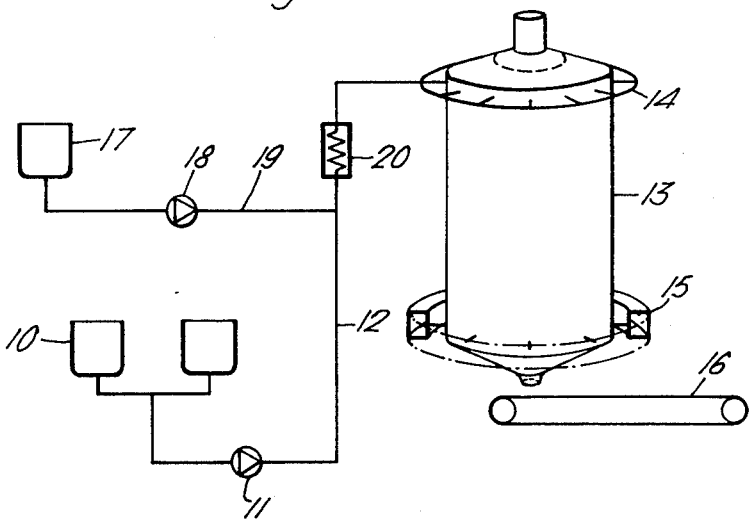

PROCESS FOR MANUFACTURE OF POWDERED DETERGENT COMPOSITIONS CONTAINING FATTY ACID SOAPS

This invention relates to the manufacture of detergent powder by spray-drying.

Spray-dried detergent powders have been formulated with a variety of detergent active substances. Anionics, such as alkylbenzene sulphonates and alkyl sulphates, soaps, nonionics such as alcohol ethoxylates and mixtures of these have all been used. As is described in earlier patent applications in our name, we have discovered a number of advantages in the use of fairly large quantities of soap in detergent powders. In particular, soap is almost completely biodegradable and also provides a very desirable soft feel to washed clothing.

However, powders containing large quantities of soap are not easy to manufacture. One difficulty is that slurries containing large quantities of soap are extremely viscous when normal amounts of water are used, which results in their having to be diluted to a greater extent than is usual. This leads to a larger amount of water than is desirable needing to be evaporated, which is uneconomic. Another difficulty is that slurries for such powders aerate extremely readily and consequently produce powders of very low bulk density, which can be disadvantageous.

We have now discovered that spray-dried soap-containing washing powders can be manufactured satisfactorily by removing some or all of the soap, or its fatty acid precursor, from the main slurry of washing powder components and forming it into a separate stream, recombining the two streams at a later stage.

Accordingly, the invention provides a process for the manufacture of a soap-containing washing powder wherein an aqueous slurry of washing powder components is formed into a first stream and spray-dried, characterised in that at least part of the soap component or the fatty acid precursor thereof is formed into a second stream and admixed with the first stream prior to spray-drying.

A first preferred method of admixing the second stream with the first is to admix it with pressurised slurry in the first stream, desirably by injecting it into the high pressure line carrying slurry to the spray-drying tower.

A second preferred method is to conduct both streams to a pump where they are pressurised and admixed simultaneously.

The invention is particularly applicable to washing powders containing from 8–25% by weight of soap.

Preferably, alkali is present in or is admixed with the aqueous slurry of washing powder components in an amount sufficient both to neutralise the admixed acid and to provide the required pH in the spray-dried powder.

The fatty acids which can be admixed with the slurry are the well-known natural or synthetic fatty acids having about 8 to about 22 carbon atoms. These are usually straight chain materials and can be saturated or unsaturated. Normally the fatty acids will be derived from naturally occurring oils and fats such as coconut oil, groundnut oil and tallow and will therefore be mixtures. For ease of incorporation, fatty acids which are or become liquid at low temperatures, i.e. less than 70° C. are preferred. These are generally the lower molecular weight acids and in particular the unsaturated ones.

Such acids are more prevalent in coconut oil, groundnut oil and sunflower oil than in other common oils such as rapeseed oil and tallow class fats.

As implied earlier, instead of admixing free fatty acid it is possible to admix a liquid or liquefied mixture of soaps. In such a case, of course, only a reduced amount of alkali will be necessary in the slurry. Admixture of soaps can be regarded as admixture of a mixture of fatty acid and of alkali.

A eutectic mixture can be used in such a process and an example of such a mixture is described in our British Pat. Application No. 1 461 586.

Furthermore, it is even possible to admix a soap solution, although since slurries are usually formulated to contain the minimum possible amount of water (since to evaporate unnecessary water is costly), and since admixing a solution involves adding additional water, this embodiment would only be economically attractive under special circumstances.

The balance of the aqueous slurry will contain conventional washing powder ingredients in conventional amounts. For instance, it may contain anionic surface active agents such as a soap of either the same or of a different fatty acid from that admixed later, an alkyl benzene sulphonate, an alkyl sulphate, an olefine sulphonate or a secondary alkane sulphonate. These surfactants may be present in amounts such that they constitute up to 10% by weight of the spray-dried powder.

Alternatively, it may contain a nonionic surfactant such as an ethoxylated alcohol or phenol.

Preferred ethoxylated alcohols for use in this invention are derived from the following series.

Tergitols (Trade Mark) which are a series of ethoxylates of secondary alcohols sold by the Union Carbide Corporation, especially Tergitol 15-S-7, 15-S-9, 15-S-12, and 15-S-15, which are ethoxylates of a mixture of $C_{11-15}$ alcohols and Tergitols 45-S-7, 45-S-9, 45-S-12 and 45-S-15, which are ethoxylates of a mixture of $C_{14}$ and $C_{15}$ alcohols, the degree of ethoxylation being shown by the postscript.

Ethoxylates of primary alcohols made by the Oxo process and containing about 20% of alpha-branched material sold by Shell Chemicals Ltd and Shell Chemicals Inc as Dobanols and Neodols (Registered Trade Marks) respectively, especially Dobanol and Neodol 25-7, 25-12 and 25-15, which are ethoxylates of a mixture of $C_{12}$–$C_{15}$ alcohols and Dobanol 45-8, 45-9, 25-12 and 25-15, which are ethoxylates of a mixture of $C_{14-15}$ alcohols.

Ukanils (Trade Mark) which are a series of ethoxylates of Oxo alcohols containing about 25% of alpha methyl branched and about 10% of ethyl branched material and Acropols (Trade Mark) manufactured by Ugine Kuhlmann et Cie, especially Acropol 35-7, 35-9, 35-11 and 35-15, which are derived from a mixture of $C_{13}$–$C_{15}$ alcohols.

Synperonics (Trade Mark), a series of ethoxylates of alcohols containing 45–55% of alkyl branching, mostly methyl branching, sold by Imperial Chemical Industries Limited, especially those based on a $C_{13-15}$ mixture of alcohols and ethoxylated to 7,9,11 and 15 units of ethylene oxide.

Ethoxylates of primary Ziegler alcohols Alfols (Trade Mark) derived from oxidative polymerisation of ethylene, manufactured by Conoco-Condea, especially Alfol 12/14-7, 12/14-9, 12/14-12, 12/14-15 and Alfol 14/12-7, 14/12-9, 14/12-12, 14/12-15, which are ethoxylates of mixtures of $C_{12}$ and $C_{14}$ alcohols.

Ethoxylates of primary Oxo alcohols about 60% branched material, sometimes called Lials (Trade Mark) produced from olefins manufactured by Liquichemica.

Lastly, ethoxylates of alcohols derived from natural materials such as fats and oils, particularly from tallow class fats, can also be used. Examples of these are tallow alcohol ethoxylates containing from 5–30, particularly 10–25 moles of ethylene oxide per mole of alcohol.

The required HLB can be achieved by selecting the carbon chain length of the hydrophobe and the length of the ethyleneoxy chain in a single or substantially single material (because of the nature of their process of production, all nonionic surfactants which are spoken of as if they were single substances are in fact mixtures). It can also be achieved by deliberately taking two "substances" of widely differing HLB's and mixing them. This approach is described in Netherlands Pat. Application No. 7 413 522 and in Netherlands Pat. Application No. 7 406 003. It is also possible to obtain the required HLB by "stripping" some chain lengths from a nonionic surfactant mixture as described in patent applications based on U.S. Ser. No. 453,464 and U.S. Pat. No. 3,682,849.

These nonionic surfactants may be present in amounts of from 2 to 20% by weight of the spray-dried powder, preferably 4 to 15%.

Both conventional detergency builders and those proposed in response to pressure for the reduction of phosphorus levels in effluent are suitable for use with this invention. Thus, the orthophosphates, pyrophosphates, tripolyphosphates, carbonates and silicates can be used with or without crystallisation seeds in the case of the precipitant builders, e.g. calcite with sodium carbonate, as can nitrilotriacetates, oxydisuccinates, citrates, oxydiacetates, alkenyl succinates, polyacrylates and malonates. Other examples are carboxymethylsuccinates. sulphonated fatty acid salts and aluminosilicate ion exchange compounds, e.g. zeolites A and K. These materials may be used, either sparingly or in admixture, in amounts of from 10% to 40%, depending upon the efficiency of the builder chosen and the amount of soap in the formulation, since soap also acts as a detergency builder.

Other conventional washing powder components can, of course, be used in the process of the invention and can be added to the aqueous slurry or post-dosed into the spray-dried powder according to their known suitability for undergoing spray-drying processes.

The invention will be further described with reference to the accompanying drawings.

Figure 2:
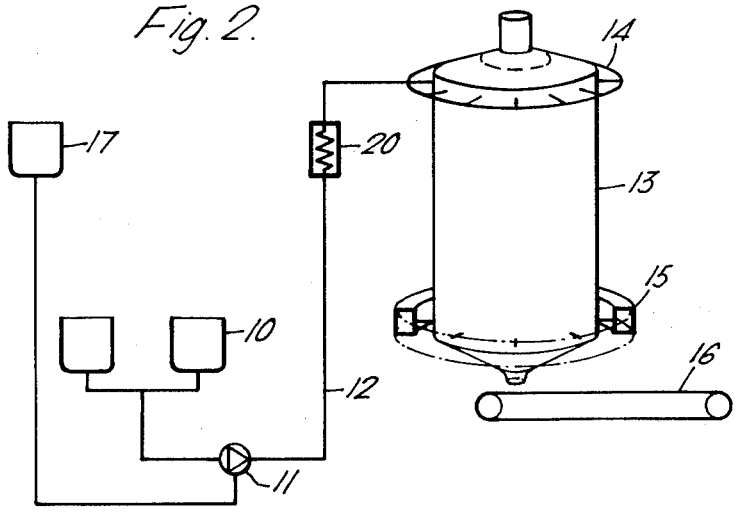

FIG. 1 of which is a schematic representation of a first apparatus for carrying out the invention, and FIG. 2 of which is a similar representation of a second apparatus for carrying out the invention.

Referring first to FIG. 1, crutchers (10) are connected via a low pressure line to a pressurising pump (11). A high pressure line (12) then leads to the nozzles (14) of a spray-drying tower (13). The spray-drying tower is provided with a hot-air ring main (15) and conveyor means (16) for removing spray-dried powder in a conventional manner.

The special feature of the first embodiment of apparatus for use with the process of the invention is that an additional high pressure line (19) leads to the line (12), this line being fed from a vessel (17) through a pressurising pump (18).

Immediately downstream of the junction between lines (19) and (12) a static in-line mixer (20) is situated. This consists of a cylindrical chamber containing stationary baffles.

In use, detergent ingredients are slurried with water and fed in a first stream under pressure provided by pump (11) to the spray-drying tower (13) where the slurry in spray-dried in a conventional manner. Simultaneously fatty acid or soap, either liquid, liquefied or in solution, is fed in a second stream to pump (18) and then into the high pressure line (12) to the spray-drying tower where it is sprayed through nozzles (14) in a conventional manner.

Referring now to FIG. 2, which downstream from the static in-line mixer (20) is identical with FIG. 1, crutchers (10) are connected via a low pressure line, high pressure line (12) and static mixer (20) to the spray-drying tower. Vessel (17) intended for fatty acid, partly or wholly neutralised fatty acid or a solution thereof, is connected directly with pressurising pump (11).

In use fatty acid or soap, either liquid, liquefied or in solution, is fed in a second stream to the pressurising pump (11) where it meets a slurry of washing powder components. In the pump the two streams are intimately mixed and pressurised and are fed via high pressure line (12) to the static in-line mixer (20) where further mixing takes place, before being passed on to the spray-drying tower and spray-dried in the conventional way.

It is important that the two streams of fluid are thoroughly admixed, otherwise unneutralised fatty acid and free alkali can pass into the spray-drying tower.

The advantages arising from the invention are twofold. Firstly, the reduction in slurry viscosity which injection produces allows the water content to be reduced. Secondly, since the slurry has a lesser tendency to aerate in the absence of large quantities of soap, the spray-dried powder has a higher bulk density.

The following Examples illustrate the invention.

EXAMPLE 1

The following washing powder formulations were prepared by a conventional slurry-making and spray-drying procedure:

| Component | Parts by weight A |
|---|---|
| Nonionic surfactant | 2.0 |
| Coconut soap | 4.0 |
| Tallow soap | 8.0 |
| Hardened rapeseed oil soap | 3.0 |
| Sodium silicate | 10.0 |
| Sodium tripolyphosphate | 24.0 |
| Trisodium phosphate | — |
| Sodium sulphate | 14.0 |
| Sodium carboxymethylcellulose | 1.0 |
| Moisture and minor components | 10.4 |

The moisture content of the slurry was 47% by weight. The bulk density of the spray-dried washing powder formulation was 0.19 gm/ml.

The following powder formulations were also prepared, but part of the soap was omitted from the crutcher slurry and instead, an equivalent amount of fatty acid was admixed with the slurry in the high pressure line (12) as shown in FIG. 1 of the accompanying drawings. The slurry contained additional caustic soda to neutralise the fatty acid.

| Component | Parts by weight B | C |
|---|---|---|
| Nonionic surfactant | 2.0 | 2.0 |
| Sodium tripolyphosphate | 18.0 | 12.0 |
| Trisodium orthophosphate | 8.0 | 8.0 |
| Sodium silicate | 10.0 | 10.0 |
| Sodium sulphate | 11.0 | 17.1 |
| Sodium carboxymethylcellulose | 1.0 | 1.0 |
| Water and minor components | 10.9 | 9.9 |
| Coconut fatty acid* | 4.0 | 4.0 |
| Tallow fatty acid* | 8.0 | 8.0 |
| Hardened rapeseed oil fatty acid | 3.0 | 3.0 |

*expressed as parts of soap.

The moisture content of the slurry was 45% by weight. The bulk densities of the spray-dried washing powder formulations were 0.29 and 0.31 respectively.

The amount of water evaporated during the spray-drying process in order to produce one tonne of spray-dried fabric washing powder was 798 kg in the case of the conventional process A, and 566 kg in the case of the processes involving admixture of fatty acid B&C.

EXAMPLE 2

A washing powder having the following formulation was made by two different spray-drying methods. In one, all of the fatty acid material was included in the crutcher slurry and, in the other, all of it was admixed with the slurry in the high pressure line (12) as in FIG. 1. In the latter case an amount of free sodium hydroxide equivalent to the fatty acid injected was present in the slurry. (3.8 parts sodium hydroxide to 15.4 parts coconut oil fatty acid and 6.5 parts tallow fatty acid).

| | Parts by weight |
|---|---|
| Linear sodium dodecylbenzene sulphonate | 21.0 |
| Coconut soap | 17.0 |
| Tallow soap | 7.0 |
| Alkaline sodium silicate | 8.0 |
| Sodium sulphate | 16.8 |
| Sodium carboxymethylcellulose | 1.0 |
| Moisture and minor ingredients | 13.2 |

The bulk density of the powder prepared by the method involving injection of fatty acid was 0.31 gm/cc, whereas that of the powder prepared conventionally was 0.43 gm/cc.

The amount of water evaporated during the spray-drying process in order to produce one tonne of spray-dried fabric washing powder was 625 kg in the case of the conventional process and 591 kg in the case of that involving admixture of fatty acid.

The experiments in Examples 1 and 2 demonstrate the effect of admixture of fatty acid with an aqueous slurry in increasing the bulk density of spray-dried powders containing relatively large amounts of soap and in reducing the amount of water needing to be evaporated.

What is claimed is:

1. A process for the manufacture of a soap-containing washing powder comprising the steps of (a) forming a first stream comprising an aqueous slurry comprising an anionic surface active agent, a nonionic surface active agent or a detergency builder, either singly or in any combination;

(b) forming a second stream comprising soap or a fatty acid precursor thereof;

(c) admixing said first and second streams; and (d) spray-drying the mixture to a soap-containing washing powder.

2. A process in accordance with claim 1, wherein said second stream comprises fatty acid and said first stream sufficient alkali to neutralise that fatty acid.

3. A process in accordance with claim 1, wherein said second stream is admixed with pressurised slurry in said first stream.

4. A process in accordance with claim 1, wherein said first and second streams are admixed and pressurised simultaneously.

5. A process in accordance with claim 1, wherein said fatty acid has a melting point below 70° C.

6. A process in accordance with claim 1, wherein said fatty acid and/or soap content of said first and second streams is such that the washing powder produced contains 8–25% by weight of soap.

7. A process in accordance with claim 1, wherein said first stream comprises a nonionic surfactant in an amount such that the washing powder produced contains 2 to 20% by weight of nonionic surfactant.

* * * * *